US006474786B2

(12) United States Patent
Percin et al.

(10) Patent No.: US 6,474,786 B2
(45) Date of Patent: Nov. 5, 2002

(54) MICROMACHINED TWO-DIMENSIONAL ARRAY DROPLET EJECTORS

(75) Inventors: Gökhan Percin, Los Altos, CA (US); Butrus T. Khuri-Yakub, Palo Alto, CA (US)

(73) Assignee: The Board of Trustees of the Leland Stanford Junior University, Stanford, CA (US)

( * ) Notice: Subject to any disclaimer, the term of this patent is extended or adjusted under 35 U.S.C. 154(b) by 0 days.

(21) Appl. No.: 09/791,991

(22) Filed: Feb. 22, 2001

(65) Prior Publication Data

US 2001/0038402 A1 Nov. 8, 2001

Related U.S. Application Data

(60) Provisional application No. 60/184,691, filed on Feb. 24, 2000.

(51) Int. Cl.[7] ..... B41J 2/15; B41J 2/04

(52) U.S. Cl. ..... 347/54; 347/20; 347/40

(58) Field of Search ..... 347/40, 44, 54, 347/68, 20

(56) References Cited

U.S. PATENT DOCUMENTS 3,958,255 A * 5/1976 Chiou et al. ..... 347/47
4,032,929 A 6/1977 Fischbeck et al.
4,115,789 A 9/1978 Fischbeck
5,821,958 A 10/1998 Lim
5,828,394 A 10/1998 Khuri-Yakub et al.
6,045,208 A 4/2000 Hirahara et al.
6,196,664 B1 3/2001 Kanda et al.
6,247,790 B1 * 6/2001 Silverbrook et al. ..... 347/54

OTHER PUBLICATIONS

Percin et al., "*Piezoelectrically Actuated Droplet Ejector*" 012/97 Rev. Sci. Instrum 68(12), pp. 4561–4563.

* cited by examiner

*Primary Examiner*—John Barlow
*Assistant Examiner*—An H. Do
(74) *Attorney, Agent, or Firm*—Dorsey & Whitney LLP

(57) ABSTRACT

A droplet ejector including a cylindrical reservoir closed at one end with an elastic membrane including at least one aperture. A bulk actuator at the other end for actuating the fluid for ejection through the aperture.

Also disclosed is a micromachined two-dimensional array droplet ejector. The ejector includes a two-dimensional array of elastic membranes having orifices closing the ends of cylindrical fluid reservoirs. The fluid in the ejectors is bulk actuated to set up pressure waves in the fluid which cause fluid to form a meniscus at each orifice. Selective actuation of the membranes ejects droplets. In an alternative mode of operation, the bulk pressure wave has sufficient amplitude to eject droplets while the individual membranes are actuated to selectively prevent ejection of droplets.

26 Claims, 4 Drawing Sheets

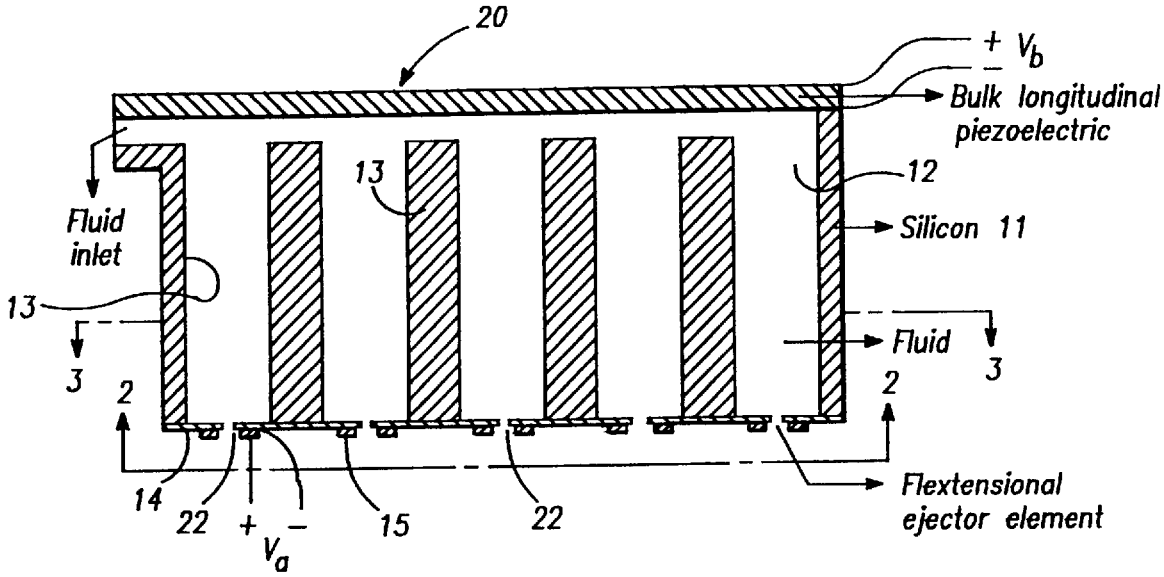
FIG.−1
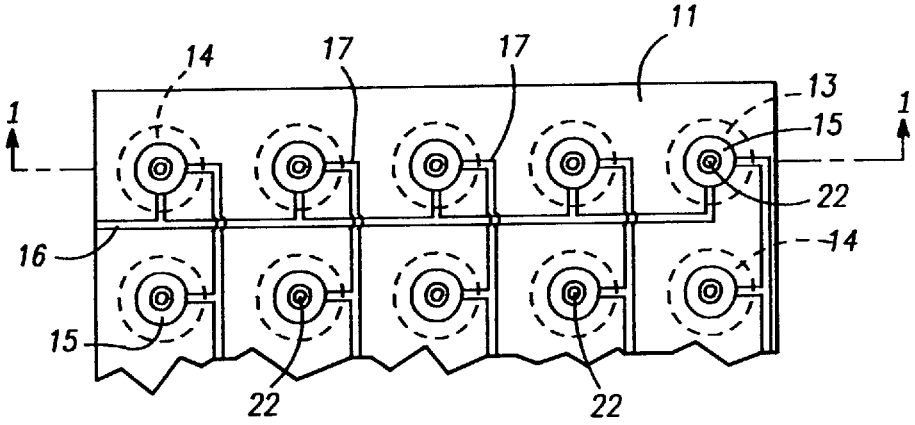
FIG.−2
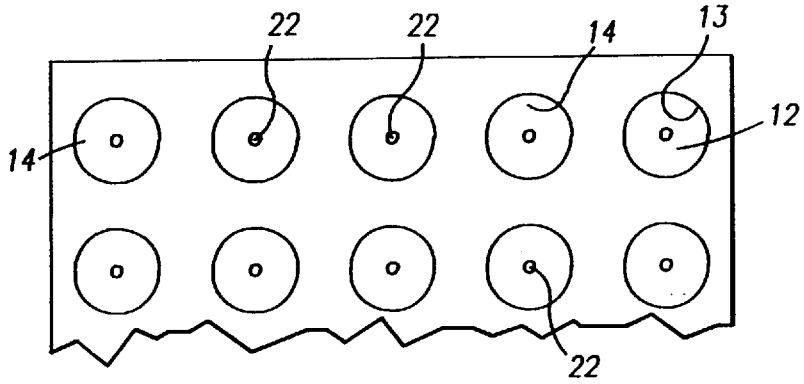
FIG.−3

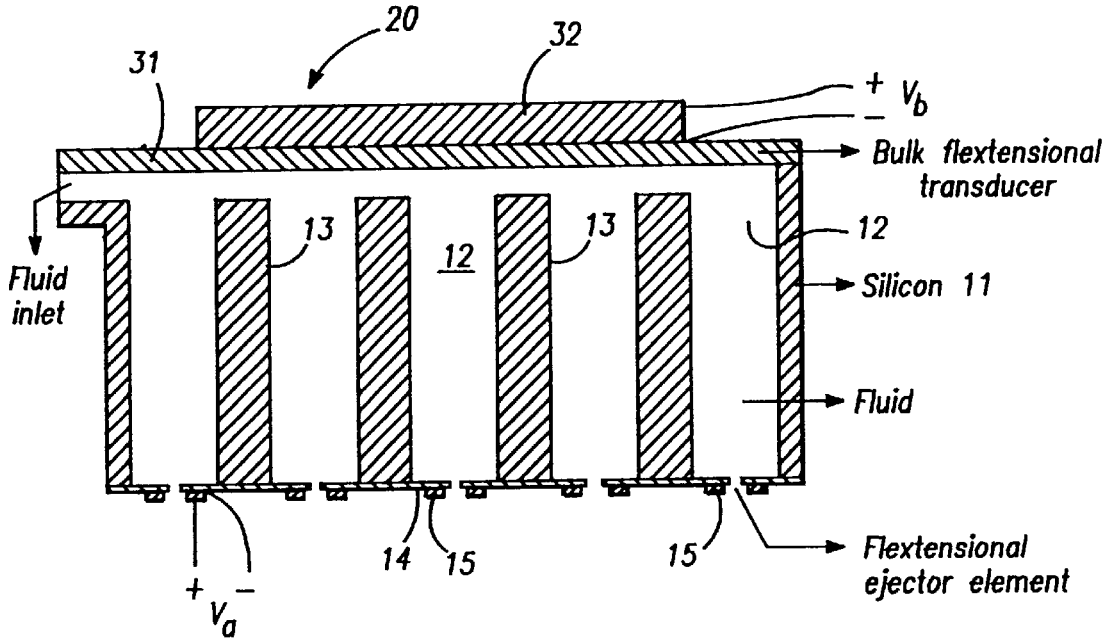
FIG.−4
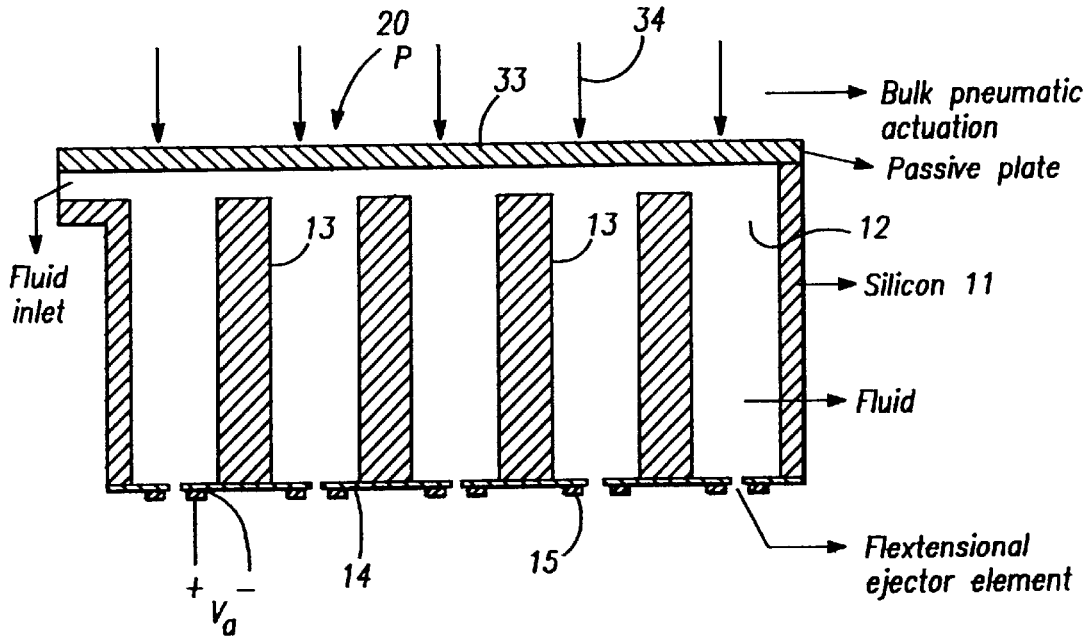
FIG.−5

MICROMACHINED TWO-DIMENSIONAL ARRAY DROPLET EJECTORS

RELATED APPLICATIONS

This application claims priority to provisional application serial No. 60/184,691 filed Feb. 24, 2000.

GOVERNMENT SUPPORT

This invention was made with Government support under Contract No. F49620-95-1-0525 awarded by the Department of the Air Force Office of Scientific Research. The Government has certain rights in this invention.

BRIEF DESCRIPTION OF THE INVENTION

This invention relates generally to fluid drop ejectors and method of operation, and more particularly an array of fluid drop ejectors wherein the drop size, number of drops, speed of ejected drops and ejection rate are controllable.

BACKGROUND OF THE INVENTION

Fluid drop ejectors have been developed for inkjet printing. Nozzles which allow the formation and control of small ink droplets permit high resolution printing resulting in sharp character and improved tonal resolution. Drop-on-demand inkjet printing heads are generally used for high resolution printers.

In general, drop-on-demand technology uses some type of pulse generator to form and eject drops. In one example, a chamber having a nozzle is fitted with a piezoelectric wall which is deformed when a voltage is applied. As a result, the fluid is forced out of the nozzle orifice and impinges directly on the associated printing surface. Another type of printer uses bubbles formed by heat pulses to force fluid out of the nozzle. The drops are separated from the ink supply when the bubbles collapse. In U.S. Pat. No. 5,828,394 there is described a fluid drop ejector which includes one wall having a thin elastic membrane with an orifice defining a nozzle and transducer elements responsive to electrical signals for deflecting the membrane to eject drops of fluid from the nozzle. The disclosed fluid drop ejector includes a matrix of closely spaced membranes and elements to provide for the ejection of a pattern of droplets. An improvement employing piezoelectric actuating transducers is disclosed in co-pending application Ser. No. 09/098,011 filed Jun. 15, 1998. The teaching of the '394 patent and of the co-pending application are incorporated herein in their entirety by reference. In order to obtain high resolution, many closely spaced ejector elements are required. For high resolution, the elastic membranes are in the order of 100 microns in diameter. We have found that, due to the small size of the elastic membranes, the displacement of the membranes is, in some cases, insufficient to eject certain fluids and solid particles.

OBJECTS AND SUMMARY OF THE INVENTION

It is an object of the present invention to provide an improved droplet ejector.

It is another object of the present invention to provide an improved two-dimensional array droplet ejector.

The foregoing and other objects of the invention are achieved by a material ejector which includes a cylindrical reservoir with an elastic membrane closing one end, and bulk actuation for resonating the material in said reservoir to eject the material through an orifice in said membrane. The injector may include an array of membranes and a single bulk actuator or an array of bulk actuators. The membrane may include individual actuators.

BRIEF DESCRIPTION OF THE DRAWINGS

The invention will be more fully understood from the following description when read in conjunction with the accompanying drawings, wherein:

FIG. 1 is a cross-sectional view of a typical micromachined two-dimensional array droplet ejector in accordance with the present invention taken along the line 1—1 of FIG. 2.

FIG. 2 is a view taken along the line 2—2 of FIG. 1, showing the elastic membranes and piezoelectric actuator.

FIG. 3 is sectional view taken along the line 3—3 of FIG. 1, showing the wells which retain the fluid or particulate matter to be ejected.

FIG. 4 is a cross-sectional view of a micromachined two-dimensional array droplet ejector illustrating another type of bulk flextensional transducer.

FIG. 5 is a sectional view of a micromachined two-dimensional array droplet ejector with pneumatic bulk actuation.

DESCRIPTION OF PREFERRED EMBODIMENT(S)

Figure 6A:
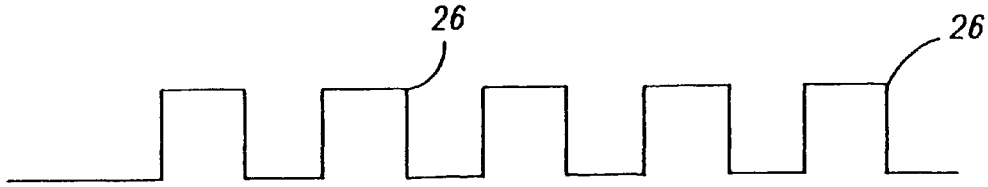
FIGS. 6*a*–6*b* schematically show electrical excitation signals applied for bulk and elemental actuation.

Referring to FIGS. 1–3, a micromachined two-dimensional array droplet ejector is shown. The ejector comprises a body of silicon 11 in which a plurality of cylindrical fluid reservoirs or wells 12 with substantially perpendicular walls 13 are formed as for example by masking and selectively etching the silicon body 11. The etching may be deep reactive ion etching. The one end of each well is closed by a flextensional ejector element (elastic membrane) 14 which may comprise a silicon or a thin silicon nitride membrane. The silicon nitride membrane can be formed by growing a thin silicon nitride layer on the bulk silicon prior to etching the wells. The thickness is preferably as thin as 0.25 microns in thickness. The flextensional ejector elements 14 may include transducers or actuators for deflecting or displacing the elements responsive to an electrical control signal. In the example of FIGS. 1–3, the membranes are deflected by annular piezoelectric actuators 15. A more detailed description of piezoelectrically actuated ejector elements is provided in said co-pending application Ser. No. 09/098,011. The piezoelectric actuators have conductive layers on both faces which are connected to leads 16 and 17 which form a matrix. One or more of the piezoelectric actuators 14 can be selectively actuated by applying electrical pulses to selected lines 16 and 17. Actuation of the piezoelectric actuators causes the corresponding membrane to deflect. Thus, there is provided means for deflecting the individual membrane of the array elements much in the same manner as described in U.S. Pat. No. 5,828,394, which is incorporated in its entirety herein by reference.

Figure 6B:
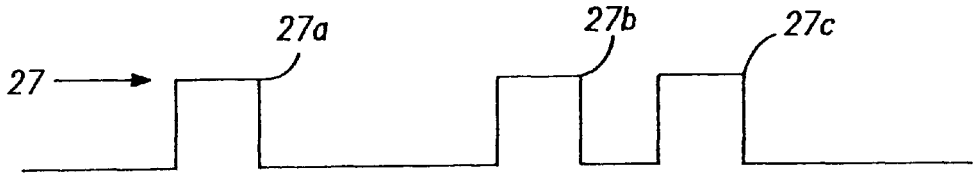

The two-dimensional array droplet ejector also includes bulk actuation means 20 for bulk actuation of the fluid within the wells to set up standing pressure waves in the fluid. For example, in FIG. 1 the bulk actuation means comprises longitudinal piezoelectric member 21 which forms the upper wall of the fluid enclosure. In one mode of operation, the bulk longitudinal piezoelectric member is excited to provide standing pressure waves in the fluid of such amplitude that the fluid forms a meniscus at each of the orifices or apertures 22 formed in the membrane 14. When the individual piezoelectric actuators are actuated, they will move the membrane and eject the fluid in the meniscus. That is, the membrane moves toward the fluid to eject a droplet. This provides an improved ejection of droplets because the droplets are partially formed by the pressure waves. In this mode of operation, the bulk actuation waves and actuation of the individual array element actuation occur in phase at the fluid/liquid interface of the orifice. The frequencies of the bulk and individual array element actuations should be the same for continuous mode ejection, e.g. one drop per cycle. However, these frequencies may be different for tone burst mode of ejection, e.g. several drops per bulk wave cycle. FIG. 6*a* shows the bulk actuation pulses 26, while FIG. 6*b* shows the in phase selected element actuation pulses 27. The amplitude of either of these pulses is selected such that in and of itself it will not eject droplets. However, the combined amplitude of the bulk pressure waves and the array element actuation pulses are sufficient to eject droplets. Referring to FIGS. 6A and 6B, it is seen that droplets are ejected at 27*a,* 27*b* and 27*c*. In essence, the individual ejector elements (membranes) act as switches, operable at relatively high frequencies to eject droplets. If the bulk actuation pulses have a long duration, the membrane may be actuated several times to eject a number of droplets for each bulk pressure wave.

Figure 7A:
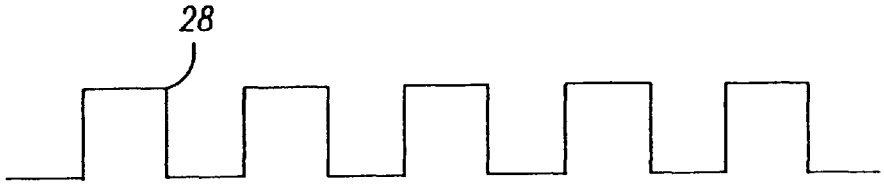
FIGS. 7*a*–7*b* schematically show excitation signals applied in another method of bulk and elemental actuation.
Figure 7B:
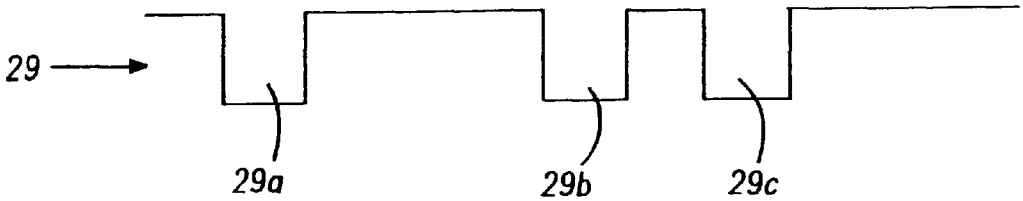

In another mode of operation, the bulk actuation waves have an amplitude large enough to eject fluid droplets through the orifices of the individual array elements, one for each cycle. However, if the array elements are individually excited out of phase, they will inhibit the ejection by moving the array element membrane away from the fluid to prevent droplet ejection. That is, they act as switches which turn off droplet ejection. This is illustrated in FIG. 7, wherein 7*a* shows the pulse amplitude of bulk waves 28 sufficient to eject droplets, whereas the out-of-phase membrane actuation shown in FIG. 7*b* at 29 will stop the ejection of such droplets at 29*a,* 29*b* and 29*c*.

Thus, in either of the above events, application of a signal to the bulk actuation piezoelectric transducer sets up the pressure waves which affect the fluid at each membrane while individual excitation of the flextensional diaphragms via the piezoelectric actuators acts as a switch to turn on or off the ejection of the droplet depending upon the amplitude of the bulk pressure waves. The diaphragms or membranes therefore control the drop ejection. Thus, by applying control pulses to the lines 16 and 17, the droplet ejection pattern can be controlled.

FIG. 4 shows a droplet ejector in which the bulk excitation is by a diaphragm 31 and a piezoelectric element 32. All other parts of the fluid drop ejector array are the same as in FIG. 1 and like reference numbers have been applied. In FIG. 5, the same array includes a flexible wall 33 which is responsive to pressure, arrows 34, such as pneumatic pressure, magnetic actuation or the like, to set up the bulk pressure waves.

It is to be understood and is apparent that although a piezoelectric transducer has been described and illustrated for driving the elastic membranes, other means of driving the elastic membranes such as electrostatic deflection or magnetic deflection are means of driving the membranes. Typical drive examples are described in U.S. Pat. No. 5,828,394.

Figure 8:
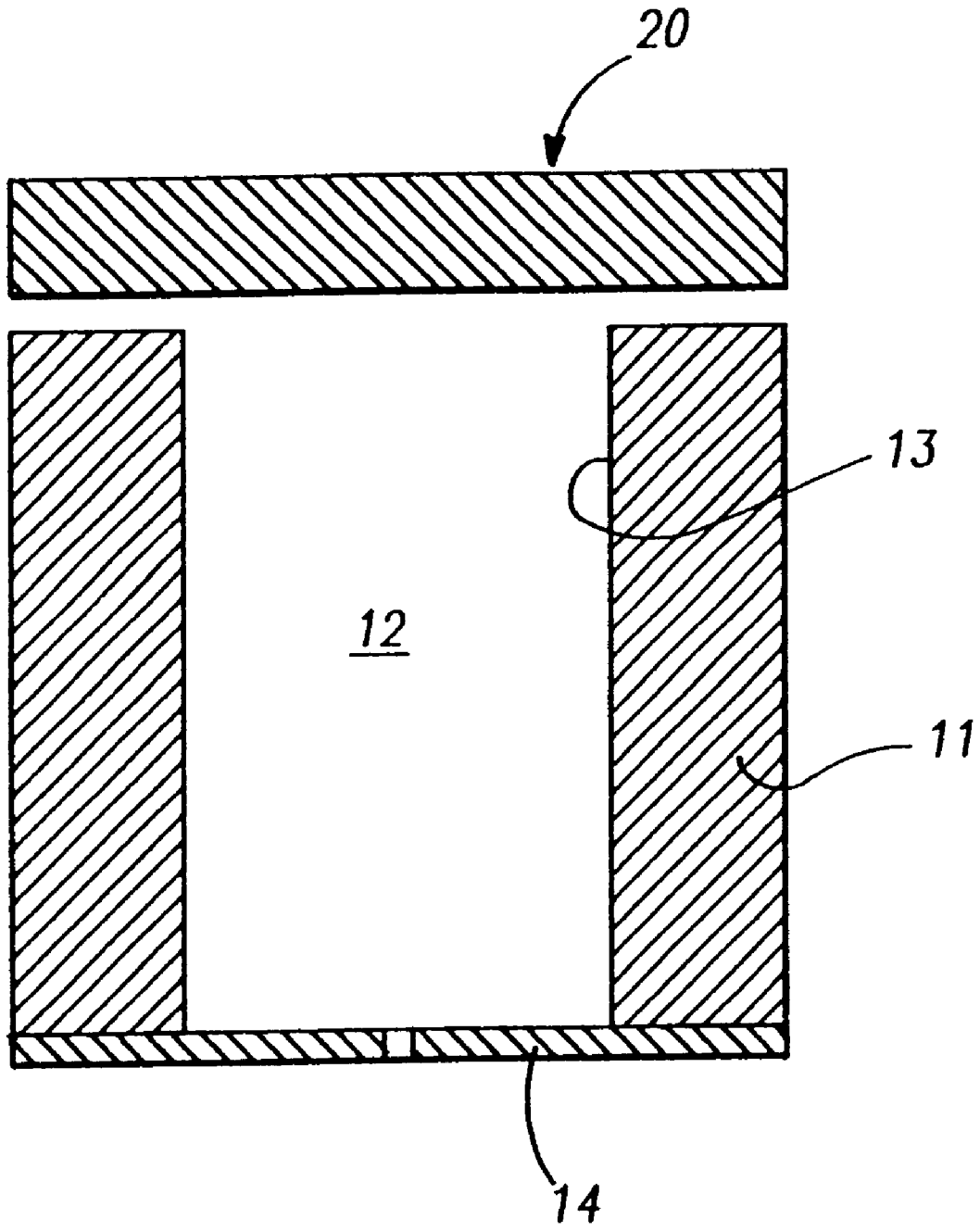
FIG. 8 is a cross-sectional view of a droplet ejector in accordance with another embodiment of the present invention.

In one example, the diameter of the wells was 100 microns, the depth of the wells was 500 microns, the membrane was 0.25 microns thick, and the orifice was 4 microns. The spacing between orifices was in the order of 100 microns. It is apparent that other size orifice wells and spacing would operate in a similar manner. FIG. 8 shows a micromachined droplet ejector which does not include a membrane actuator. In this droplet ejector, the fluid reservoir becomes an acoustic cavity resonator which resonates at the resonance frequency of the bulk actuator, which is tuned to the same frequency as the resonant frequency of the membrane loaded with fluid. The cylindrical configuration increases the quality of the resonator. At resonance, the membrane vibrates flexurally, vibrating the orifice, generating fluid droplets as small as 4 microns in diameter. The bulk actuation mechanism sets up standing waves in the fluid reservoir. This is in contrast to squeezing the fluid chamber as in the prior art. In other words, the fluid reservoir behaves as an acoustic cavity resonator. Therefore, incident and reflected acoustic waves interfere constructively at the orifice plane.

Thickness mode piezoelectric transducers in either longitudinal or shear mode can be used for bulk actuation. Single or multiple (i.e. arrays of) thickness mode piezoelectric transducers can be used for the bulk actuation. The bulk actuation can be piezoelectric, piezoresistive, electrostatic, capacitive, magnetostrictive, thermal, pneumatic, etc. Piezoelectric, electrostatic, magnetic, capacitive, magnetostrictive, etc. actuation can be used for the array elements. The actuation of the original array elements can be performed by selectively activating the piezoelectric elements associated with each orifice to act as a switch to either turn on or turn off the ejection of drops. The meniscus of the orifice can always vibrate (not as much as for ejection) to decrease transient response, to decrease drying of the fluid and prevent self-assembling of the fluid ejected near the orifice. Excitation frequencies of bulk and individual array element actuations can be the same or different depending upon the application.

The devices eject fluids, small solid particles and gaseous phase materials. The droplet ejector can be used for inkjet printing, biomedicine, drug delivery, drug screening, fabrication of biochips, fuel injection and semiconductor manufacturing.

The thickness of the membrane in which the orifice is formed is small in comparison to the droplet (orifice size), which results in perfect break-up and pinch-off of the ejected droplets from the air-fluid interface. Although a silicon substrate or body having a plurality of cylindrical reservoirs has been described, it is clear that the substrate or body can be other types of semiconductive material, plastic, glass, metal or other solid material in which cylindrical reservoirs can be formed. Likewise, the apertured membrane has been described as silicon nitride or silicon. It can be of other thin, flexible material such as plastic, glass, metal or other material which is thin and not reactive with the fluid being ejected. An ejector of the type shown in FIG. 8 may form part of an array. An array of bulk actuators would be associated with the array of cylindrical reservoirs, one for each reservoir, whereby there can be selective ejection of droplets from the apertures. Although each membrane has been illustrated with a single aperture, the membranes may include multiple apertures to increase the volume of fluid which is ejected in such applications as fuel injection.

What is claimed:

1. A two-dimensional array droplet ejector including:

a body with a plurality of cylindrical wells, an elastic membrane closing one end of each of said plurality of wells, each elastic membrane including at least one aperture, membrane displacement means responsive to applied electrical signals for selectively displacing said membranes, and bulk displacement means in contact with said fluid in all of said wells to provide bulk actuation of the fluid so that the bulk pressure wave is applied to all of membranes, whereby the bulk actuation and the selective membrane displacement combine to selectively eject fluid droplets through said apertures.

2. A two-dimensional array as in claim 1 in which the body is silicon micromachined by masking and etching to form said plurality of cylindrical wells.

3. A two-dimensional array as in claim 1 in which the body is selected from semiconductor material, metal, plastic or glass.

4. A two-dimensional array as in claim 2 in which said elastic membranes are semiconductor material.

5. A two-dimensional array as in claim 2 or 3 in which the membrane is selected from silicon nitride, silicon, semiconductor material, plastic, metal or glass.

6. A two-dimensional array as in claim 1 in which the bulk displacement means comprise thickness mode piezoelectric transducers operated in the shear or longitudinal mode.

7. A two-dimensional array as in claim 1 in which the bulk displacement means is selected from the group comprising electrostatic, piezoelectric, magnetostatic, magnetostrictive or pneumatic.

8. A two-dimensional array as in claim 7 in which the membrane displacement means is selected from the group comprising electrostatic, electromagnetic, magnetostrictive, piezoelectric and thermal.

9. A two-dimensional array as in claim 1 in which the membrane displacement means is selected from the group comprising electrostatic, electromagnetic, magnetostrictive, piezoelectric and thermal.

10. A two-dimensional array fluid droplet ejector including:

a semiconductor substrate having a plurality of closely spaced cylindrical wells, an elastic membrane of semiconductor material closing one end of each of said plurality of wells, each elastic membrane including at least one aperture, membrane displacement means associated with each of said membranes for displacing the membrane responsive to an electrical command, means for selectively exciting the membrane displacement means, and bulk fluid displacement means associated with the fluid to provide bulk actuation of the fluid to generate fluid pressure waves at each of said membranes.

11. A two-dimensional array as in claim 10 in which the substrate is a silicon body micromachined by etching to form said plurality of wells.

12. A two-dimensional array as in claim 10 in which the bulk displacement means comprise thickness mode piezoelectric transducers operated in the shear or longitudinal mode.

13. A two-dimensional array as in claim 10 in which the bulk displacement means is selected from the group comprising electrostatic, piezoelectric magnetostatic, or pneumatic.

14. A two-dimensional array as in claim 10 in which the membrane displacement means is selected from the group comprising electrostatic, electromagnetic, magnetostrictive, piezoelectric and thermal.

15. A two-dimensional array as in claim 10 in which said bulk fluid displacement means includes a plurality of displacement means, one associated with each of said cylindrical wells, and means for selectively exciting said individual bulk displacement means.

16. The method of operating a two-dimensional droplet ejector array of the type including a substrate with a plurality of wells, an elastic membrane closing one end of each of said plurality of wells, each elastic membrane including at least one aperture, membrane displacement means responsive to applied electrical signals for selectively displacing said membranes, and bulk displacement means associated with said fluid to provide bulk actuation of the fluid so that the bulk pressure wave is applied to all of membranes, whereby the bulk actuation and the selective membrane displacement combine to selectively eject droplets, comprising the steps of applying bulk actuation waves having an amplitude sufficient to form a meniscus at each aperture without ejecting droplets and selectively applying electrical signals to said membrane displacement means of sufficient amplitude to eject droplets.

17. The method of operating a two-dimensional droplet ejector array of the type including a substrate with a plurality of wells, an elastic membrane closing one end of each of said plurality of wells, each elastic membrane including at least one aperture, membrane displacement means responsive to applied electrical signals for selectively displacing said membranes, and bulk displacement means associated with said fluid to provide bulk actuation of the fluid so that the bulk pressure wave is applied to all of membranes, whereby the bulk actuation and the selective membrane displacement combine to selectively eject droplets, comprising the steps of applying bulk actuation waves having an amplitude sufficient to eject droplets from each of said apertures and selectively applying electrical signals to said membrane displacement means to inhibit ejection of droplets from selected apertures.

18. The method of claim 16 or 17 including the step of applying electrical signals to said membrane displacement means which cause the membrane to vibrate.

19. A two-dimensional array droplet ejector including:

a body with a plurality of cylindrical wells, an elastic membrane closing one end of each of said plurality of wells, each elastic membrane including at least one aperture, and bulk displacement means in contact with said fluid in all of said wells to provide bulk actuation of the fluid so that the bulk pressure wave is applied to all of the membranes, whereby the bulk actuation ejects fluid droplets through said apertures.

20. A two-dimensional array as in claim 19 in which the body is silicon micromachined by masking and etching to form said plurality of cylindrical wells.

21. A two-dimensional array as in claim 20 in which said elastic membranes are semiconductor material.

22. A two-dimensional array as in claim 19 in which the bulk displacement means comprise thickness mode piezoelectric transducers operated in the shear or longitudinal mode.

23. A fluid droplet ejector comprising:

a body having at least one cylindrical reservoir, an elastic membrane closing one end of the reservoir, said membrane including at least one aperture, and bulk displacement means associated with the material in said reservoir to actuate the fluid in said reservoir to deflect the membrane and eject fluid droplets through said aperture.

24. A fluid dropiet ejector as in claim 23 in which said membrane is provided with actuation means whereby the membrane can be independently deflected.

25. A fluid droplet ejector as in claim 24 including a plurality of cylindrical reservoirs, and a plurality of membranes, and bulk actuation means to simultaneously actuate the fluid in all of said reservoirs.

26. A fluid drop ejector as in claim 23 including a plurality of cylindrical reservoirs, a plurality of membranes, one for each reservoir, and a plurality of bulk displacement means, one for each reservoir, and means for selectively actuating the displacement means to selectively eject fluid droplets.

* * * * *